US008164276B2

(12) United States Patent
Kuwabara

(10) Patent No.: US 8,164,276 B2
(45) Date of Patent: Apr. 24, 2012

(54) LED DRIVE DEVICE, LED DRIVE METHOD AND LIGHTING SYSTEM

(75) Inventor: Kesanobu Kuwabara, Azumino (JP)

(73) Assignee: Fuji Electric Co., Ltd. (JP)

( * ) Notice: Subject to any disclaimer, the term of this patent is extended or adjusted under 35 U.S.C. 154(b) by 285 days.

(21) Appl. No.: 12/609,729

(22) Filed: Oct. 30, 2009

(65) Prior Publication Data

US 2010/0194298 A1 Aug. 5, 2010

(30) Foreign Application Priority Data

Oct. 30, 2008 (JP) ..... 2008-279936

(51) Int. Cl.
*H05B 37/02* (2006.01)

(52) U.S. Cl. ..... 315/294; 315/185 R; 315/224; 315/226; 315/299; 315/302; 315/307

(58) Field of Classification Search ..... 315/185 R, 315/209 R, 210, 224, 226, 291, 294, 299, 315/302, 307

See application file for complete search history.

(56) References Cited

U.S. PATENT DOCUMENTS

| | | | | |
|---|---|---|---|---|
| 5,959,413 | A * | 9/1999 | Komarek et al. | 315/306 |
| 7,081,722 | B1 * | 7/2006 | Huynh et al. | 315/323 |
| 7,564,198 | B2 * | 7/2009 | Yamamoto et al. | 315/307 |
| 7,636,037 | B2 * | 12/2009 | Ito et al. | 340/458 |
| 2008/0191642 | A1 | 8/2008 | Slot et al. | |

FOREIGN PATENT DOCUMENTS

| | | | |
|---|---|---|---|
| JP | 11-135274 | A | 5/1999 |
| JP | 2004-039289 | A | 2/2004 |
| JP | 2004-119422 | A | 4/2004 |
| JP | 2006-147933 | A | 8/2006 |
| JP | 2006-202855 | A | 8/2006 |
| JP | 2006-210835 | A | 8/2006 |
| JP | 2006-244848 | A | 9/2006 |
| JP | 2008-059811 | A | 3/2008 |
| JP | 2008535279 | T | 8/2008 |

* cited by examiner

*Primary Examiner* — Thuy Vinh Tran
(74) *Attorney, Agent, or Firm* — Rossi, Kimms & McDowell LLP

(57) ABSTRACT

A drive circuit drives LED groups each of which has a plurality of LEDs connected in series. The drive circuit includes nMOSFETs which drive the LED groups, current regulating circuits which determine drain currents of the nMOSFETs, and subtracters which control the current regulating circuits to keep the sum of the current values of adjacent two nMOSFETs constant. The LEDs can be switched on/off efficiently even when there are differences between forward voltages of the LEDs.

6 Claims, 5 Drawing Sheets

LED DRIVE DEVICE, LED DRIVE METHOD AND LIGHTING SYSTEM

BACKGROUND

The present invention relates to an LED drive device, an LED drive method and a lighting system. Particularly it relates to an LED drive device and an LED drive method for driving a plurality of series-connected LEDs, and a lighting system.

Lighting systems using a plurality of LEDs (Light Emitting Diodes) have recently been developed. A switching method and a linear control method have been used as control methods in the lighting systems. The former method uses a switching power supply circuit for supplying a constant current from an AC power supply to each LED. The latter method detect an AC voltage or a current flowing in LEDs and changes the number of switched-on LEDs to minimize power supply loss. Examples of conventional systems are illustrated in JP-A-2006-244848, JP-A-2008-59811 and JP-A-2006-147933

The switching method, however, has a problem in that noise occurs at the time of switching, and a problem that a large number of parts are required because the circuit configuration is rather complicated. Conventional linear control methods also has problems.

For example, in JP-A-2006-244848, when the alternating voltage value increases, switches are not turned off but the number of turned-on switches is increased. Accordingly, there is a problem that efficiency is very poor. In JP-A-2008-59811 and JP-A-2006-147933, the input voltage is monitored so that switching elements are switched in accordance with the input voltage. There is however a problem that this method cannot accept differences between forward voltages of LEDs. For example, when the forward voltages of LEDs mounted as products are 19V and 21V though the drive voltage of each LED is designed to be 20V, there is a possibility that the current flowing in the drive circuit may be interrupted.

For this reason, it is necessary to adjust the voltage at the time of shipping. There is a problem that the number of processes at the time of shipping increases.

SUMMARY OF THE INVENTION

The invention provides an LED drive device, an LED drive method and a lighting system in which LEDs can be switched on/off efficiently even when there are differences between forward voltages of the LEDs.

In a preferred embodiment, an LED drive device is provided for driving a plurality of series-connected LEDs, including: a first switching element which drives at least one of the LEDs; a second switching element which drives at least one of other LEDs than the LED driven by the first switching element; and a control circuit which controls the first switching element so that the sum of the value of a current flowing in the first switching element and the value of a current flowing in the second switching element is kept constant.

According to the LED drive device, the first switching element is controlled by the control circuit so that the sum of the value of the current flowing in the first switching element and the value of the current flowing in the second switching element is kept constant.

According to the disclosed LED drive device, the LEDs can be switched on/off efficiently because the current can be switched smoothly even when there are differences between forward voltages of the LEDs.

Further advantages, features, objects, etc. of the invention will become apparent to those skilled in the art from the following detailed description of the preferred embodiments

BRIEF DESCRIPTION OF THE DRAWINGS

The invention will be described with reference to certain preferred embodiments thereof and the accompanying drawings, wherein.

DETAILED DESCRIPTION OF THE INVENTION

Figure 1:
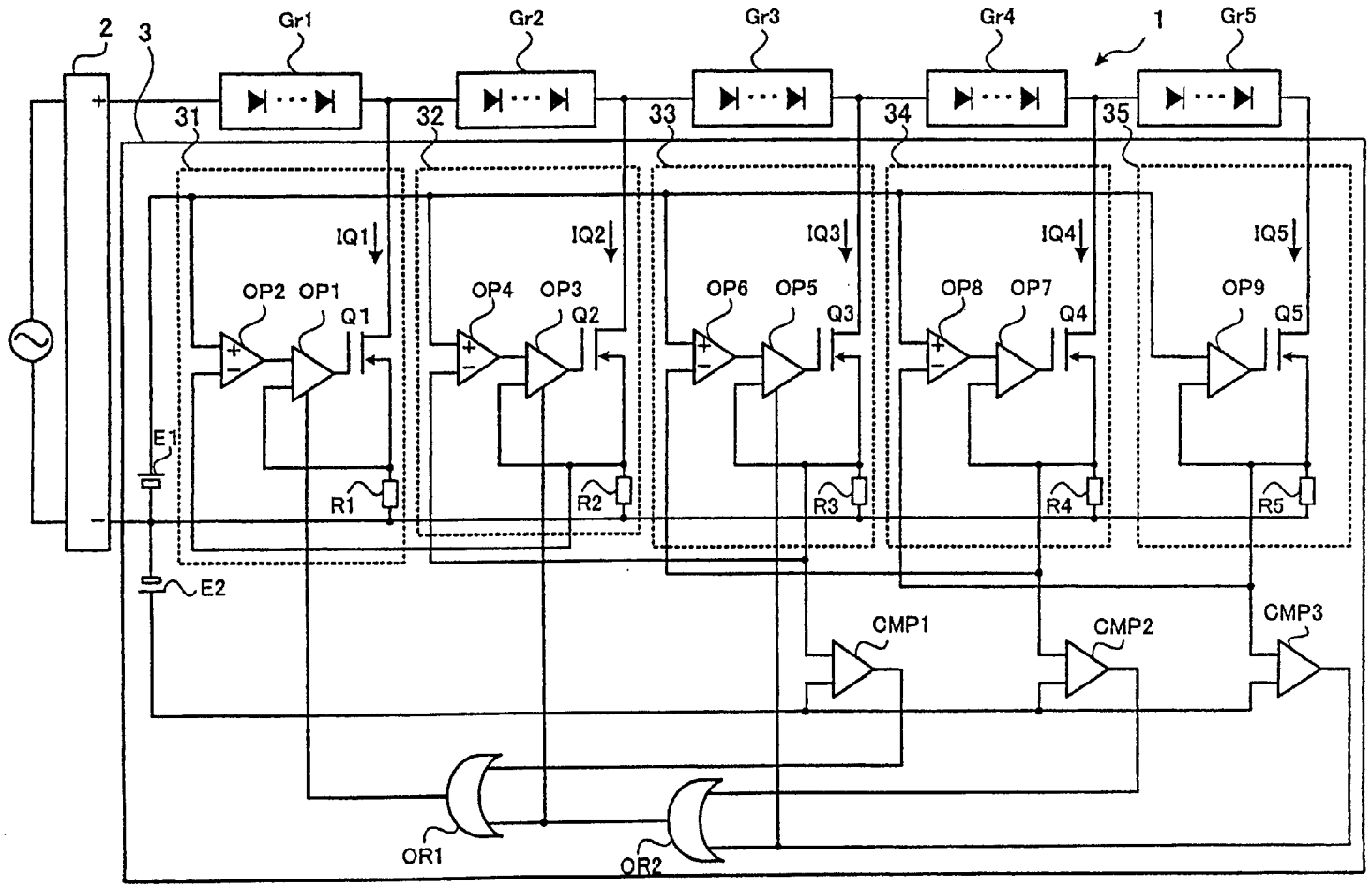
FIG. 1 is a circuit diagram showing a lighting system according to an embodiment of the invention.

FIG. 1 is a circuit diagram showing a lighting system according to an embodiment of the invention. The lighting system 1 includes: a full-wave rectifier 2; LED groups Gr1 to Gr5 each of which has a plurality of LEDs; and a drive circuit (LED drive device) 3 which drives the LED groups Gr1 to Gr5. The full-wave rectifier 2 has a diode bridge (not shown) which full-wave rectifies an alternating voltage of 50Hz 100V or 60Hz 100V.

In the following description, the case where an alternating voltage of 100V is used is taken as an example. It understood, however, that the invention is not limited thereto but can be applied to various alternating voltages. If respective values of resistance, withstand voltage, etc. can be set in accordance with various alternating voltages to be used, the invention can be applied to the various alternating voltages.

The LED groups Gr1 to Gr5 are driven (switched on) when 20V is applied to the LED groups Gr1 to Gr5. The drive circuit 3 switches on/off the LED groups Gr1 to Gr5 in accordance with the value of the full-wave rectified voltage. The drive circuit 3 has: a circuit 31 provided so as to correspond to the LED group Gr1; a circuit 32 provided so as to correspond to the LED group Gr2; a circuit 33 provided so as to correspond to the LED group Gr3; a circuit 34 provided so as to correspond to the LED group Gr4; a circuit 35 provided so as to correspond to the LED group Gr5; comparators (break circuits) CMP1 to CMP3; and OR circuits OR1 and OR2.

The circuit 31 has: an nMOSFET (first switching element) Q1 which is connected to an output side of the LED group Gr1 so that an output current of the LED group Gr1 is used as a drain current IQ1; a current regulating circuit OP1 which is connected to a gate of the nMOSFET Q1; a subtracter (current setting circuit) OP2 which regulates the amount of a constant current of the current regulating circuit OP1; and a resistor R1 (100Ω in this embodiment) which is connected between a source of the nMOSFET Q1 and the ground GND in order to detect the current amount of the drain current IQ1 in conjugation with a voltage source E1 supplying a voltage (1V in this embodiment) serving as a command value for the drain current of the nMOSFET Q1 (nMOSFETs Q1 to Q5).

The current regulating circuit OP1 operates the nMOSFET Q1 in an active region while converting the voltage applied to an input terminal of the current regulating circuit OP1 into a current to thereby regulate the current amount of the drain current IQ1 of the nMOSFET Q1.

The current regulating circuit OP1 further has a terminal (forced OFF terminal) through which the current regulating circuit OP1 is forcedly turned off when a signal of logic "H" is input to the forced OFF terminal. This terminal is connected to an output terminal of the OR circuit OR1.

A plus terminal of the subtracter OP2 is connected to the voltage source E1. A minus terminal of the subtracter OP2 is connected to a resistor R2 (100Ω in this embodiment) which is connected between a source of the nMOSFET (second switching element) Q2 and the ground GND in order to determine the maximum current amount of the drain current IQ2 in conjugation with the voltage source E1.

The subtracter OP2 subtracts the voltage value of the source of the nMOSFET Q2 from the voltage value of the voltage source E1 and supplies a resulting voltage value to the current regulating circuit OP1. As described above, the current regulating circuit OP1 regulates the current amount of the drain current of the nMOSFET Q1 so that a current corresponding to the voltage value flows in the nMOSFET Q1.

In this configuration of the circuit 31, the resistor R1 detects the current amount of the drain current IQ1. When the detection result is input to the current regulating circuit OP1, the current regulating circuit OP1 regulates the gate of the nMOSFET Q1 so that the drain current IQ1 is made coincident with the setting value given from the subtracter OP2.

Each of the circuits 32 to 34 has the same configuration as that of the circuit 31. The circuit 35 has the same configuration as those of the circuits 31 to 34 except that there is no subtracter provided in front of the current regulating circuit OP9 and the input terminal of the current regulating circuit OP9 is connected to the voltage source E1.

The source-drain withstand voltage of each of the nMOSFETs Q1 to Q4 is at least 20V. The source-drain withstand voltage of the nMOSFET Q5 is at least 41V ($100\times2^{1/2}-100$).

The comparator CMP1 compares the source voltage of the nMOSFET (third switching element) Q3 with the output voltage of a switching current reference voltage source E2 set as a predetermined value to switch the logic of each of the comparators CMP1 to CMP3. The comparator CMP1 outputs the comparison result to the OR circuit OR1.

In this embodiment, the output voltage of the switching current reference voltage source E2 is set at 0.1V. The comparator CMP1 outputs a signal of logic "H" when the source voltage of the nMOSFET Q3 exceeds 0.1V.

The comparator CMP2 compares the source voltage of the nMOSFET (fourth switching element) Q4 with the output voltage of the switching current reference voltage source E2 and outputs the comparison result to the OR circuit OR2. The comparator CMP3 compares the source voltage of the nMOSFET Q5 with the output voltage of the switching current reference voltage source E2 and outputs the comparison result to the OR circuit OR2 and the forced OFF terminal of the current regulating circuit OP5.

The OR circuit OR1 implements ORing the logic of the comparator CMP1 and the logic of the OR circuit OR2 and outputs the ORed result to the current regulating circuit OP1. The OR circuit OR2 implements ORing the logic of the comparator CMP2 and the logic of the comparator CMP3 and outputs the ORed result to the OR circuit OR1 and the forced OFF terminal of the current regulating circuit OP3.

Figure 2:
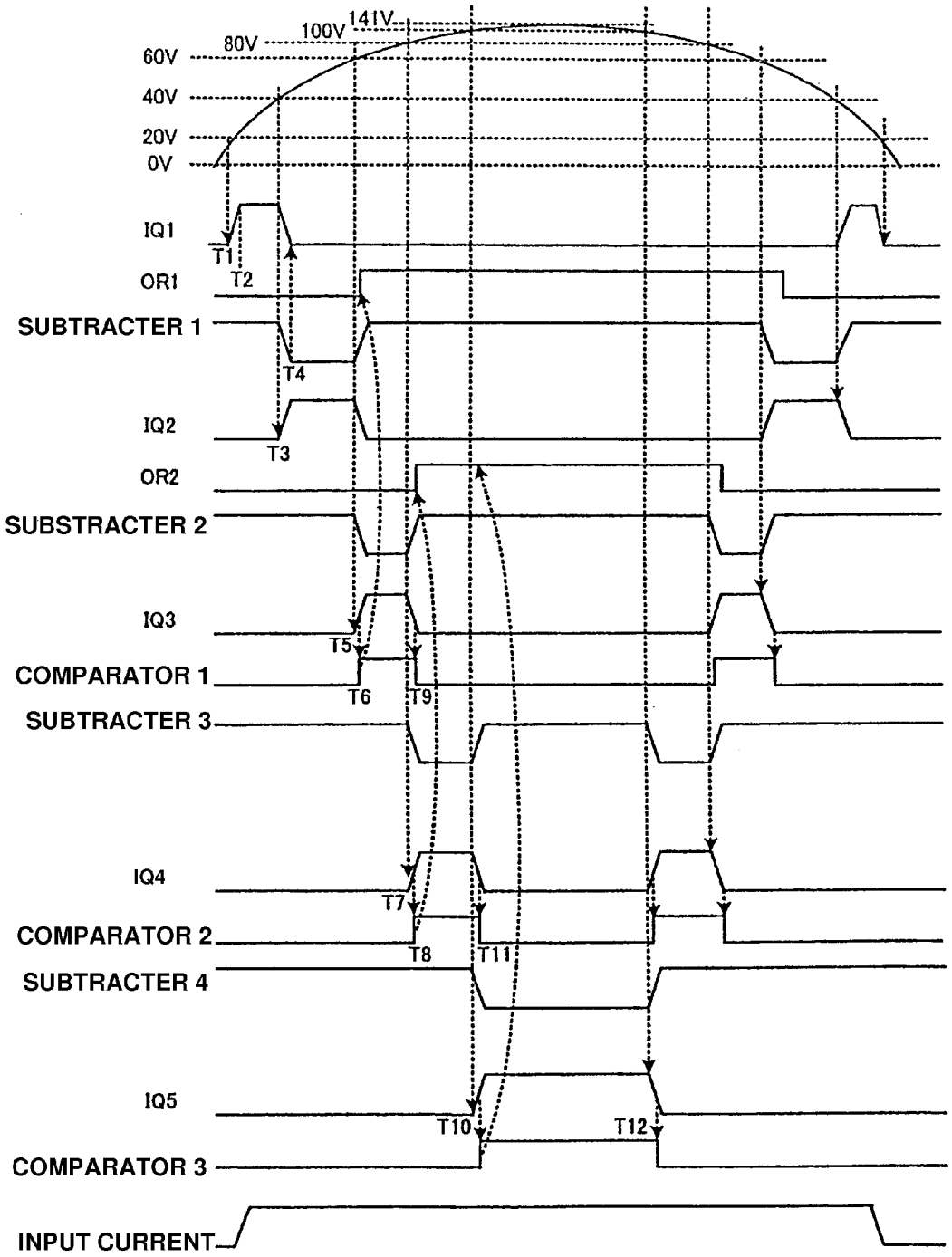
FIG. 2 is a time chart showing the operation of the lighting system.

The operation of the lighting system 1 will be described next. FIG. 2 is a time chart showing the operation of the lighting system. The operation of the lighting system 1 will be described below based on the circuit shown in FIG. 1 and the time chart shown in FIG. 2.

In FIG. 2, "IQ1" indicates change of the current value of the drain current IQ1. "OR1" indicates logic of the output terminal of the OR circuit OR1. "Subtracter 1" indicates the output voltage of the subtracter OP2.

"IQ2" indicates change of the current value of the drain current IQ2. "OR2" indicates logic of the output terminal of the OR circuit OR2. "Subtracter 2" indicates the output voltage of the subtracter OP4.

"IQ3" indicates change of the current value of the drain current IQ3. "Comparator 1" indicates logic of the output terminal of the comparator CMP1. "Subtracter 3" indicates the output voltage of the subtracter OP6.

"IQ4" indicates change of the current value of the drain current IQ4. "Comparator 2" indicates logic of the output terminal of the comparator CMP2. "Subtracter 4" indicates the output voltage of the subtracter OP8.

"IQ5" indicates change of the current value of the drain current IQ5. "Comparator 3" indicates logic of the output terminal of the comparator CMP3.

"Input Current" indicates the current flowing in each of the LED groups Gr1 to

Gr5.

The operation for increasing the voltage value will be described first. All the nMOSFETs Q1 to Q5 are ON by default. The subtracter OP2 applies a voltage source E1-0=1 (V) to the current regulating circuit OP1. Accordingly, the maximum current amount of the drain current IQ1 of the nMOSFET Q1 is 10 mA.

First, the voltage full-wave rectified by the full-wave rectifier 2 is applied between each of the LED groups Gr1 to Gr5 and the ground GND. When the applied voltage exceeds 20V (at time T1), the drain current IQ1 increases little by little. Incidentally, FIG. 2 shows the current increasing state (width) exaggeratedly to make the explanation easy to understand. When voltage source E1/resistance R1 becomes equal to $1/100=0.01$ (A) (10 mA), the drain current IQ1 is kept constant (10 mA) (at time T2).

When the applied voltage then exceeds 40V (at time T3), the drain current IQ2 increases little by little. On this occasion, the drain current IQ1 decreases little by little. This reason will be described below.

For example, when the drain current IQ2 becomes equal to 1 mA, resistance R2×drain current IQ2=100×0.001=0.1(V) is applied to the minus terminal (−) of the subtracter OP2. On this occasion, the subtracter OP2 applies voltage source E1−0.1=1−0.1=0.9(V) to the current regulating circuit OP1. Accordingly, the drain current IQ1 becomes 9 mA.

As described above, while the sum of the drain current IQ1 and the drain current IQ2 (the sum of the drain currents of adjacent two nMOSFETs) is kept at 10 mA, the drain current IQ1 decreases as the drain current IQ2 increases. When the drain current IQ2 becomes 10 mA, the drain current IQ1 becomes 0 mA (at time T4). However, the gate of the nMOSFET Q1 is still ON.

When the applied voltage exceeds 60V (at time T5), the drain current IQ3 increases little by little. On this occasion, the drain current IQ2 decreases little by little. When the drain current IQ3 is equal to 1 mA, resistance R3×drain current IQ3 is equal to 100×0.001=0.1(V).

Because the output voltage of the switching current reference voltage source E2 is set at 0.1V, the voltage value applied between the two input terminals of the comparator CPM1 becomes equal. Accordingly, the comparator CMP1 outputs a signal of logic "H" (at time T6). As a result, the OR circuit OR1 outputs a signal of logic "H". Accordingly, the current regulating circuit OP1 is turned OFF. As a result, the current supply to the nMOSFET Q1 is interrupted.

As described above, the provision of the comparator CMP1 can prevent the drain current IQ1 easily and surely from increasing again even when the subtracter OP2 outputs 1V induced by the drain current IQ2 of 0 mA to the current regulating circuit OP1.

When the applied voltage then exceeds 80V (at time T7), the drain current IQ4 increases little by little. On this occasion, the drain current IQ3 decreases little by little. When the drain current IQ4 is equal to 1 mA, resistance R4×drain current IQ4 is equal to 100×0.001=0.1(V).

Because the output voltage of the switching current reference voltage source E2 is set at 0.1V, the voltage value applied between the two input terminals of the comparator CPM2 becomes equal. Accordingly, the comparator CMP2 outputs a signal of logic "H" (at time T8). As a result, the OR circuit OR2 outputs a signal of logic "H". Accordingly, the current regulating circuit OP3 is turned OFF. As a result, the current supply to the nMOSFET Q2 is interrupted.

As described above, the provision of the comparator CMP2 can prevent the drain current IQ2 easily and surely from increasing again even when the subtracter OP4 outputs 1V induced by the drain current IQ3 of 0 mA to the current regulating circuit OP3.

When the drain current IQ4 becomes 9 mA or more, that is, when the drain current IQ3 becomes less than 1 mA, the comparator CMP1 outputs a signal of logic "L" (at time T9). However, because the OR circuit OR2 outputs a signal of logic "H", the OR circuit OR1 outputs a signal of logic "H" continuously. Accordingly, the current regulating circuit OP1 is still forcedly turned OFF.

In this manner, the provision of the OR circuit OR1 can prevent cancellation of the forced OFF of the current regulating circuit OP1 to which current supply was once interrupted, that is, the provision of the OR circuit OR1 can prevent the current easily and surely from flowing in the nMOSFET Q1.

When the applied voltage then exceeds 100V (at time T10), the comparator CMP3 outputs a signal of logic "H". As a result, the current regulating circuit OP5 is turned OFF. When the drain current IQ5 becomes 9 mA or more, that is, when the drain current IQ4 becomes 1 mA or less, the comparator CMP2 outputs a signal of logic "L" (at time T11). However, because the comparator CMP3 outputs a signal of logic "H", the OR circuit OR2 outputs a signal of logic "H" continuously. Accordingly, the current regulating circuits OP1 and OP3 are still forcedly turned OFF.

In this manner, the provision of the OR circuit OR2 can prevent cancellation of the forced OFF of the current regulating circuit OP3 to which current supply was once interrupted, that is, the provision of the OR circuit OR2 can prevent the current easily and surely from flowing in the nMOSFET Q2.

The operation for decreasing the voltage value will be described next. When the applied voltage becomes 100V or less, the drain current IQ5 decreases little by little and the drain current IQ4 increases little by little. When the drain current IQ5 becomes equal to 9 mA, the drain current IQ4 becomes equal to 1 mA. As described above, even at the time of decreasing the voltage value, while the sum of the drain currents of adjacent two nMOSFETs is kept at 10 mA, the drain current IQ4 increases as the drain current IQ5 decreases.

When the drain current IQ5 becomes less than 1 mA (at time T12), the comparator CMP3 outputs a signal of logic "L" to cancel the forced OFF of the nMOSFET Q3.

When the applied voltage then becomes 80V or less, the drain current IQ4 decreases little by little and the drain current IQ3 increases little by little. When the drain current IQ4 becomes less than 1 mA, the comparator CMP2 outputs a signal of logic "L". As a result, the OR circuit OR2 outputs a signal of logic "L". Accordingly, the forced OFF of the nMOSFET Q2 is cancelled.

When the applied voltage then becomes 60V or less, the drain current IQ3 decreases little by little and the drain current IQ2 increases little by little. When the drain current IQ3 becomes less than 1 mA, the comparator CMP1 outputs a signal of logic "L". As a result, the OR circuit OR1 outputs a signal of logic "L". Accordingly, the forced OFF of the nMOSFET Q1 is cancelled.

When the applied voltage then becomes 40V or less, the drain current IQ2 decreases little by little and the drain current IQ1 increases little by little. When the applied voltage then becomes 20V or less, the drain current IQ1 decreases little by little.

Figure 3:
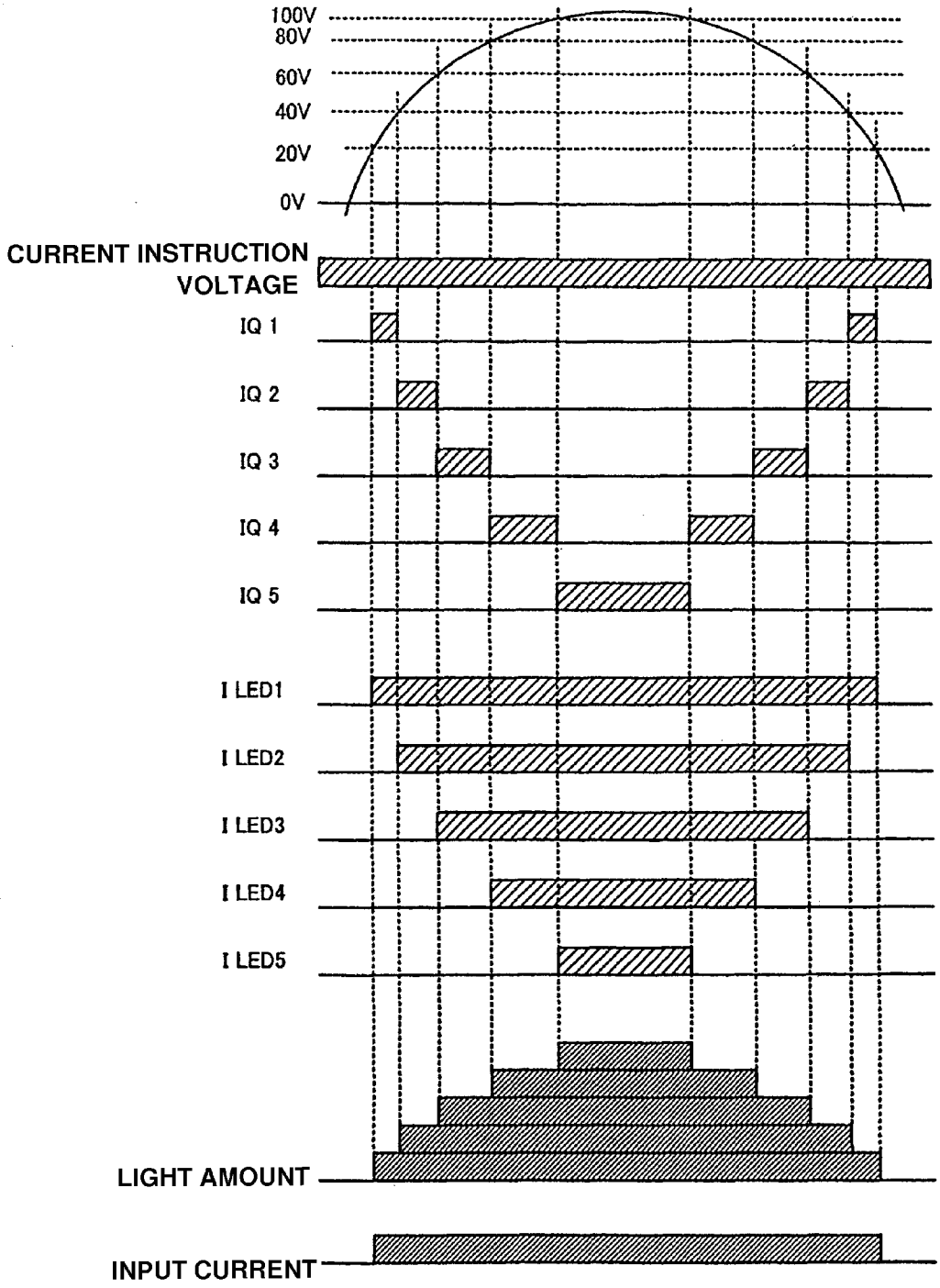
FIG. 3 is a chart showing change of the amount of light according to the operation of a drive circuit.

Even when the applied voltage changes as described above, the value of the current flowing in the drive circuit 3 never reaches "0" because a current always flows in at least one of the nMOSFETs Q1 to Q5. FIG. 3 is a chart showing change of the amount of light according to the operation of the drive circuit.

In FIG. 3, "Current Instruction Voltage" indicates change of the voltage value of the voltage source E1. "IQ1" indicates change of the current value of the drain current IQ1. "IQ2" indicates change of the current value of the drain current IQ2. "IQ3" indicates change of the current value of the drain current IQ3. "IQ4" indicates change of the current value of the drain current IQ4. "IQ5" indicates change of the current value of the drain current IQ5. "ILED1" indicates change of the current value of the LED group Gr1. "ILED2" indicates change of the current value of the LED group Gr2. "ILED3" indicates change of the current value of the LED group Gr3. "ILED4" indicates change of the current value of the LED group Gr4. "ILED5" indicates change of the current value of the LED group Gr5. "Light Amount" indicates change of the light amount of the lighting system 1. "Input Current" indicates the current flowing in each of the LED groups Gr1 to Gr5.

As shown in FIG. 3, the light amount is the sum of the LED groups Gr1 to Gr5. Incidentally, in the waveform of the light amount as shown in FIG. 3, there is a possibility that flickering may occur more or less in each step portion. However, because the full-wave rectified waveform is about 100 Hz (or 120 Hz) obtained by full-wave rectification of 50 Hz (or 60 Hz), the flickering as small as this cannot be followed by human eyes and hence does not affect human eyes.

As described above, in accordance with the lighting system 1, the circuits 31 to 35 for detecting current start of each of the LED groups Gr1 to Gr5 are provided to control the nMOSFETs Q1 to Q5 so that the sum of drain currents flowing in adjacent two nMOSFETs can be kept constant (10 mA).

Accordingly, a low-loss system can be achieved regardless of differences between forward voltages VF of the LED groups Gr1 to Gr5. Moreover, there is no current interruption because the current is switched smoothly even when there are differences between forward voltages VF of the LED groups Gr1 to Gr5.

Moreover, there is no noise induced by a switching power supply because there is no switching power supply used. Moreover, this system is superior in power factor to the switching power supply type system. Moreover, the long life of the lighting system 1 can be achieved because there is no electrolytic capacitor used.

Incidentally, the number of LEDs in each of the LED groups Gr1 to Gr5 is not particularly limited. For example, it is however preferable that the number of LEDs is set to be not larger than a value obtained by dividing the value of the maximum input voltage by the forward voltage VF of one LED, and that the number of LED groups and the number of series-connected LEDs in each of the LED groups are determined to obtain the minimum loss of the AC power supply.

Although this embodiment has been described with use of five LED groups Gr1 to Gr5 and circuits 31 to 35 for the sake of simplification of description, the invention is not limited thereto. For example, the invention can be applied to a system having four LED groups and circuits or a system having six or more LED groups and circuits. Also in this case, a circuit for driving an LED group corresponding to the highest voltage value may be formed in the same circuit configuration as the circuit 35 while other circuits may be formed in the same circuit configuration as the circuits 31 to 34. In a lighting system having a number n (n is a natural number not smaller than 4) of LED groups, a number (n−2) of comparators for interrupting current supply to nMOSFETs of current regulating circuits of first to (n−2)th circuits and a number (n−3) of OR circuits for ORing the number (n−2) of comparators may be provided in accordance with circuits corresponding to third to n-th LED groups.

A lighting system according to a second embodiment of the invention will be described below. A point of difference of the lighting system according to the second embodiment from the lighting system according to the previous embodiment will be described mainly but description of the same items will be omitted.

Figure 4:
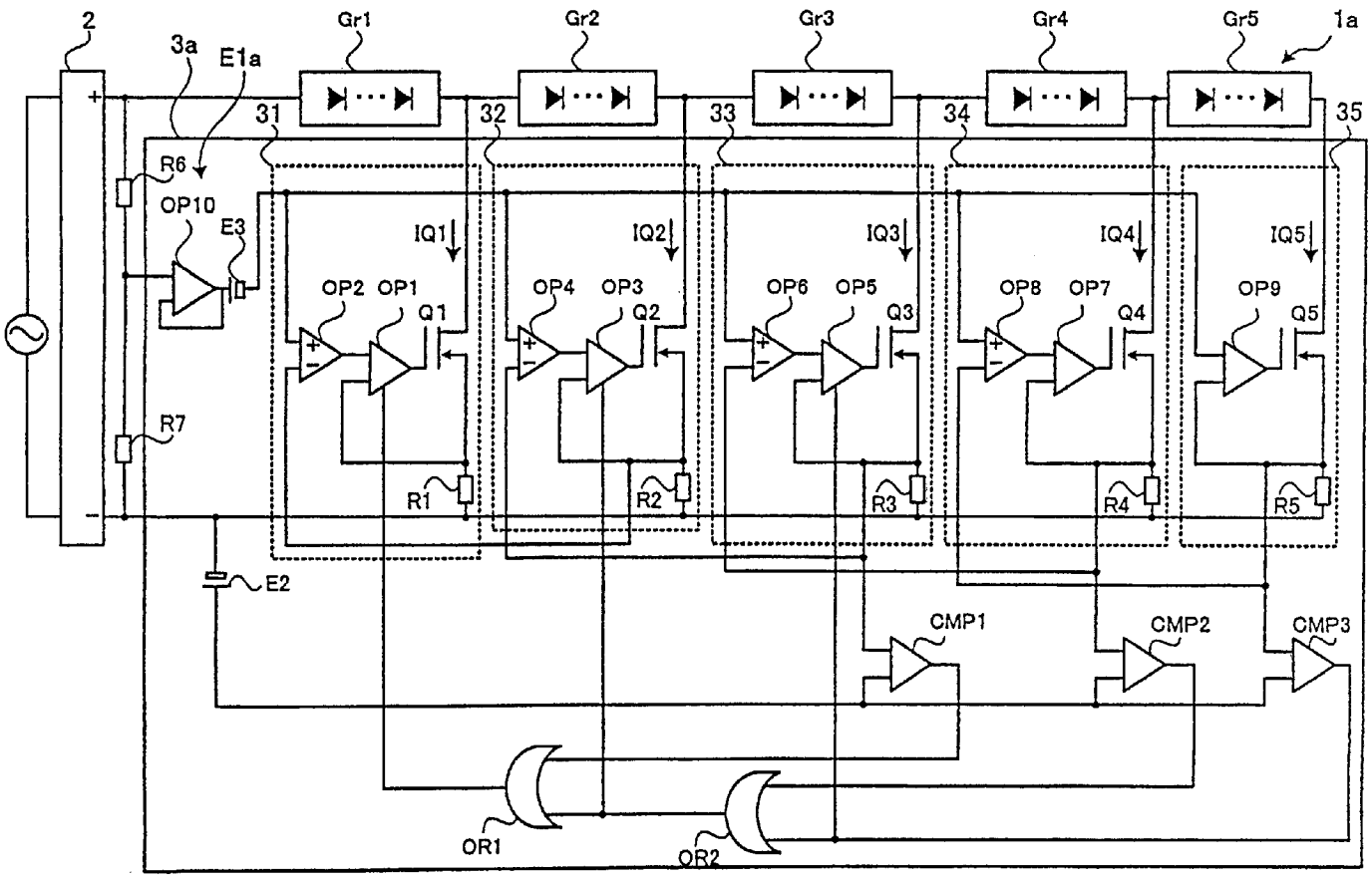
FIG. 4 is a circuit diagram showing a lighting system according to a second embodiment of the invention.

FIG. 4 is a circuit diagram showing the lighting system according to the second embodiment. As shown in FIG. 4, in the lighting system 1*a* according to the second embodiment, the configuration of a voltage source E1*a* of a drive circuit 3*a* is different from that of the voltage source E1 in the first embodiment.

The voltage source E1*a* has: an operational amplifier OP10 which forms a voltage follower; and an offset voltage source E3 which offsets the output voltage of the operational amplifier OP10. A voltage full-wave rectified and divided by resistors R6 and R7 is input to an input terminal of the operational amplifier OP10.

Figure 5:
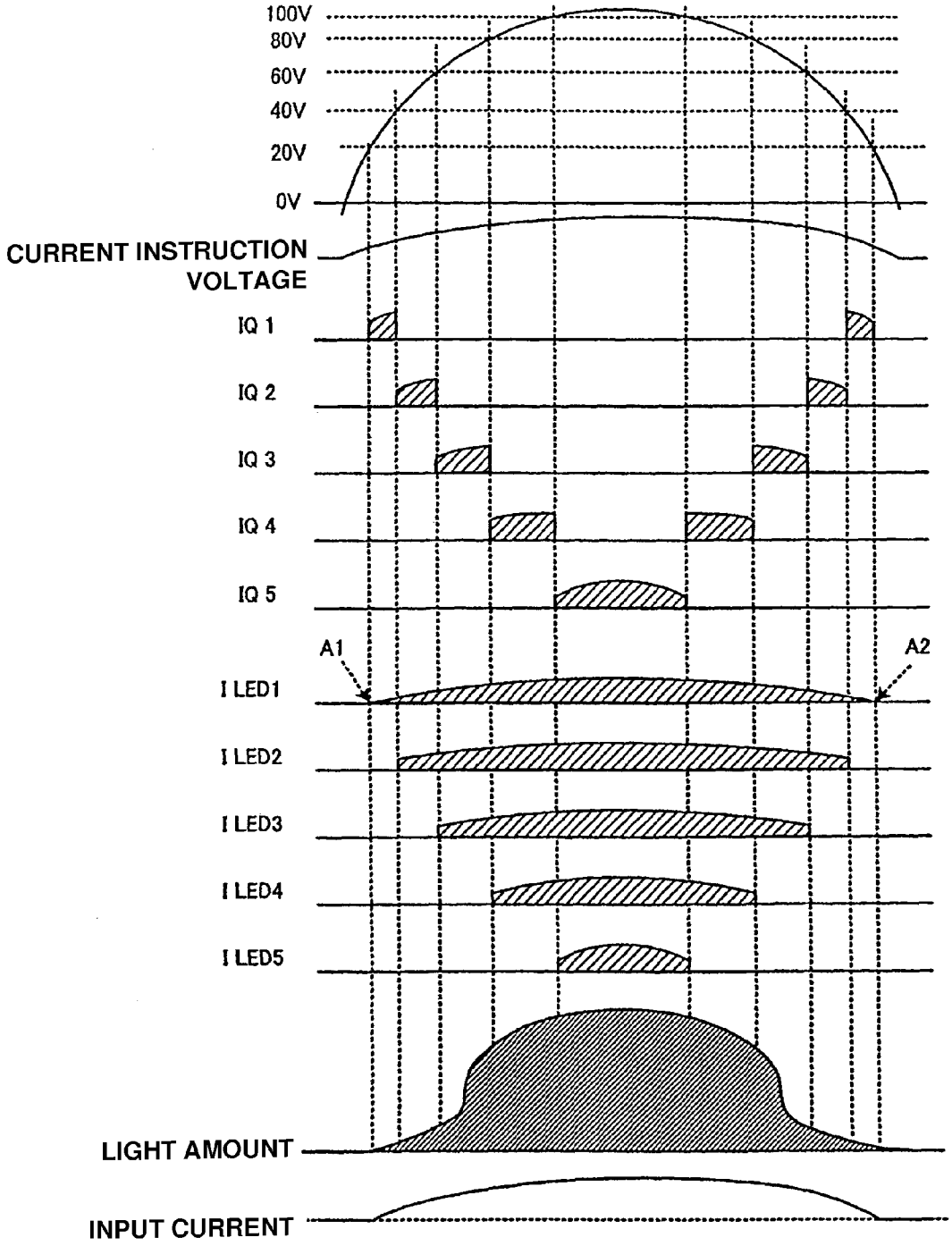
FIG. 5 is a chart showing change of the amount of light according to the operation of a drive circuit in the second embodiment.

FIG. 5 is a chart showing change of the amount of light according to the operation of the drive circuit in the second embodiment. According to the configuration of the voltage source E1*a*, change of the voltage value of the current instruction voltage is different from that in the first embodiment. Specifically, the current instruction voltage changes as a value obtained by subtracting the offset voltage from the divided voltage.

The offset voltage is set in advance in accordance with the drive voltage of the LED group Gr1 (the smallest drive voltage of the LED group). Specifically, the offset voltage is regulated so that the timing when a voltage obtained by superposing the offset voltage on a voltage the same in phase as the full-wave rectified voltage increases from zero is made substantially coincident with the timing when a current begins to flow in the LED group Gr1 driven by the nMOSFET Q1. Incidentally, it is preferable that the coincidence range (accuracy) is decided optionally by a designer from the viewpoint of suppression of harmonic waves.

When the divided voltage is input to the subtracters OP2, OP4, OP6 and OP8 as described above, the phase of the input current waveform can be made close to the phase of the input voltage waveform. Moreover, when the offset voltage is set appropriately, change (ILED1) of the current value of the LED group Gr1 can be smoothened. That is, as shown in FIG. 5, ILED1 rises smoothly and falls smoothly (see points A1 and A2 designated by the arrows in FIG. 5) compared with ILED2 to ILED5. As a result, the waveform of the light amount is made closer to a sinusoidal waveform.

In the lighting system 1*a* according to the second embodiment, the same effect as in the lighting system 1 according to the first embodiment can be obtained. Moreover, in the lighting system 1*a* according to the second embodiment, the phase of the input current waveform can be made close to the phase of the input voltage waveform, so that power factor can be improved to suppress harmonic waves.

Although the LED drive device, the LED drive method and the lighting system according to the invention have been described above based on the illustrated embodiments, the invention is not limited thereto. For example, the configuration of each part may be replaced by any configuration having the same function. In addition, any configuration or process may be added to the invention.

The application is based on and claims priority to Japanese Application 2008-279936, filed on Oct. 30, 2008. The disclosure of the priority application in its entirety, including the drawings, claims, and the specification therefore, is incorporated herein by reference.

What is claimed is:

1. An LED drive device for driving a plurality of series-connected LEDs, comprising:

a first switching element which drives at least one of the LEDs;

a second switching element which drives at least one of other LEDs different from the at least one of the LEDs driven by the first switching element; and a control circuit which controls the first switching element so that the sum of the value of a current flowing in the first switching element and the value of a current flowing in the second switching element is kept constant;

wherein the control circuit includes:

a current setting circuit which outputs a current setting value for setting the current flowing in the first switching element;

a current regulating circuit which outputs a current regulating signal for regulating the first switching element so that the current flowing in the first switching element is made coincident with the current setting value;

the LED drive device further comprising:

a third switching element which drives at least one of other LEDs different from the LEDs driven by the first and second switching elements; and a break circuit which outputs a signal for interrupting outputting of the current regulating signal to the first switching element in accordance with the value of a current flowing in the third switching element and the value of a voltage set in advance;

a fourth switching element which drives at least one of other LEDs different from the LEDs driven by the first, second and third switching elements;

a second current setting circuit which outputs a second current setting value for setting the current flowing in the second switching element;

a second switching element break circuit which outputs a signal for interrupting outputting of the current regulating signal for regulating the second switching element in accordance with the value of a current flowing in the fourth switching element and the voltage value; and a logic circuit which supplies the signal output from at least one of the break circuit and the second switching element break circuit, to the first switching element.

2. An LED drive device according to claim 1, wherein the control circuit detects change of the value of the current flowing in the second switching element and changes the current setting value.

3. An LED drive device according to claim 1, further comprising a voltage supply circuit which supplies a voltage the same in phase as a full-wave rectified voltage for driving the LEDs, to the current setting circuit.

4. An LED drive device according to claim 3, wherein:

the voltage supply circuit has an offset voltage supply circuit which superposes an offset voltage on the voltage the same in phase as the full-wave rectified voltage; and the voltage supply circuit regulates the offset voltage so that the timing when a voltage obtained by superposing the offset voltage on the voltage the same in phase as the full-wave rectified voltage increases from zero is made substantially coincident with the timing when a current begins to flow in the LED driven by the first switching element.

5. An LED drive method for driving a plurality of series-connected LEDs, comprising:

controlling a constant current circuit for determining the value of a current flowing in a first switching element so that the sum of the value of the current flowing in the first switching element for driving at least one of the LEDs and the value of a current flowing in a second switching element for driving at least one of other LEDs different from the at least one of the LEDs driven by the first switching element is kept constant controlling a current setting circuit for outputting a current setting value for setting the current flowing in the first switching element;

outputting, by a current regulating circuit, a current regulating signal for regulating the first switching element so that the current flowing in the first switching element is made coincident with the current setting value;

driving, with a third switching element, at least one of other LEDs than the LEDs driven by the first and second switching elements; and outputting, by a break circuit, a signal for interrupting outputting of the current regulating signal to the first switching element in accordance with the value of a current flowing in the third switching element and the value of a voltage set in advance;

driving, by a fourth switching element, at least one of other LEDs than the LEDs driven by the first, second and third switching elements;

outputting, by a second current setting circuit, a second current setting value for setting the current flowing in the second switching element;

outputting, by a second switching element break circuit, a signal for interrupting outputting of the current regulating signal for regulating the second switching element in accordance with the value of a current flowing in the fourth switching element and the voltage value; and supplying, by a logic circuit, the signal output from at least one of the break circuit and the second switching element break circuit, to the first switching element.

6. A lighting system for driving a plurality of series-connected LEDs, comprising:

the plurality of LEDs;

a rectifying circuit which generates a full-wave rectified voltage for driving the LEDs from an alternating voltage; and an LED drive device including a first switching element which drives at least one of the LEDs, a second switching element which drives at least one of other LEDs different from the at least one of the LEDs driven by the first switching element, and a control circuit which controls the first switching element so that the sum of the value of a current flowing in the first switching element and the value of a current flowing in the second switching element is kept constant wherein the control circuit includes:

a current setting circuit which outputs a current setting value for setting the current flowing in the first switching element;

a current regulating circuit which outputs a current regulating signal for regulating the first switching element so that the current flowing in the first switching element is made coincident with the current setting value;

the LED drive device further comprising:

a third switching element which drives at least one of other LEDs than the LEDs driven by the first and second switching elements; and a break circuit which outputs a signal for interrupting outputting of the current regulating signal to the first switching element in accordance with the value of a current flowing in the third switching element and the value of a voltage set in advance;

a fourth switching element which drives at least one of other LEDs than the LEDs driven by the first, second and third switching elements;

a second current setting circuit which outputs a second current setting value for setting the current flowing in the second switching element;

a second switching element break circuit which outputs a signal for interrupting outputting of the current regulating signal for regulating the second switching element in accordance with the value of a current flowing in the fourth switching element and the voltage value; and a logic circuit which supplies the signal output from at least one of the break circuit and the second switching element break circuit, to the first switching element.

* * * * *